US009614320B2

(12) United States Patent
Schooley

(10) Patent No.: US 9,614,320 B2
(45) Date of Patent: Apr. 4, 2017

(54) DONGLE FOR QUICK RELEASE

(71) Applicant: Google Inc., Mountain View, CA (US)

(72) Inventor: Stephen Theodore Schooley, Menlo Park, CA (US)

(73) Assignee: GOOGLE INC., Mountain View, CA (US)

( * ) Notice: Subject to any disclaimer, the term of this patent is extended or adjusted under 35 U.S.C. 154(b) by 42 days.

(21) Appl. No.: 14/468,530

(22) Filed: Aug. 26, 2014

(65) Prior Publication Data

US 2016/0064854 A1 Mar. 3, 2016

(51) Int. Cl.
*H01R 13/62* (2006.01)
*H01R 13/24* (2006.01)
*H01R 31/06* (2006.01)

(52) U.S. Cl.
CPC ..... *H01R 13/6205* (2013.01); *H01R 13/2421* (2013.01); *H01R 31/06* (2013.01)

(58) Field of Classification Search
CPC ..... H01R 13/6205; H01R 13/6587
USPC ..... 439/39, 638
See application file for complete search history.

(56) References Cited

U.S. PATENT DOCUMENTS 6,607,391 B2 8/2003 Mendelson et al.
7,264,479 B1 * 9/2007 Lee ..... H01R 11/30 439/39
7,329,128 B1 * 2/2008 Awad ..... H01R 13/6205 439/38
7,500,882 B2 * 3/2009 Goetz ..... H01R 13/2428 439/638
7,607,920 B1 10/2009 Chen
7,713,095 B2 * 5/2010 Yodogawa ..... H01R 13/2421 439/700
8,177,560 B2 5/2012 Rohrbach et al.
8,262,403 B2 9/2012 Slippy et al.
8,535,088 B2 9/2013 Gao et al.
8,894,419 B1 * 11/2014 Buelow ..... H01R 13/6205 439/218
2007/0072442 A1 * 3/2007 DiFonzo ..... H01R 13/641 439/39

(Continued)

FOREIGN PATENT DOCUMENTS

KR 101078214 B1 11/2011
KR 20130117081 A 10/2013

OTHER PUBLICATIONS

"Magnetic Laptop power connector", www.instructables.com/id/Magnetic-Laptop-power-connector/?ALLSTEPS, Published 2008, Retrieved Apr. 23, 2014.

(Continued)

*Primary Examiner* — Tulsidas C Patel
*Assistant Examiner* — Marcus Harcum
(74) *Attorney, Agent, or Firm* — Morris & Kamlay LLP

(57) ABSTRACT

Systems and techniques are provided for a dongle for quick release. The plug portion may include electrical contacts to contact electrical contacts housed within the port of the electronic device. An external face may be attached to the plug portion. The external face may include electrical contact pads. The electrical contact pads may be electrically connected to the electrical contacts. A flange may include a ferromagnetic material attached to the external face, such that the flange is disposed outside of the electronic device when the plug portion is plugged into the port of the electronic device.

11 Claims, 5 Drawing Sheets

(56) References Cited

U.S. PATENT DOCUMENTS

| | | | | |
|---|---|---|---|---|
| 2007/0072443 | A1 | 3/2007 | Rohrbach et al. | |
| 2007/0259536 | A1 | 11/2007 | Long et al. | |
| 2013/0323941 | A1 | 12/2013 | Zeliff et al. | |
| 2014/0162468 | A1* | 6/2014 | Kim | H01R 13/6205 439/39 |
| 2014/0220793 | A1* | 8/2014 | Yen | H01R 13/6205 439/39 |
| 2014/0273644 | A1* | 9/2014 | McSweyn | H01R 27/00 439/628 |
| 2014/0287601 | A1* | 9/2014 | Suh | H01R 13/6205 439/39 |
| 2015/0118868 | A1* | 4/2015 | Choi | H01R 11/30 439/39 |
| 2015/0207268 | A1* | 7/2015 | Zhu | H01R 13/24 439/39 |
| 2015/0357753 | A1* | 12/2015 | Lee | H01R 13/6205 439/39 |

OTHER PUBLICATIONS

Whitwam, "The Pogo is a concept breakaway connector that could save your phone from certain doom", www.geek.com/mobile/the-pogo-is-a-concept-breakaway-connector-that-could-save-your-phone-from-certain-doom-1567696/, Published Aug. 20, 2013, Retrieved Apr. 23, 2014.

International Search Report and Written Opinion issued Oct. 26, 2015 in corresponding International Application No. PCT/US2015/045878., Oct. 26, 2015.

* cited by examiner

DONGLE FOR QUICK RELEASE

BACKGROUND

To supply power to an electronic device, such as a smartphone or LCD screen, a user may have to insert a connector into a port, for example, a USB port, on the mobile computing device. The plug on the connector may need to be inserted into the electronic device to establish a connection that will deliver electricity to the electronic device. The insertion of the plug into the electronic device, and removal of the plug from the electronic device, may take some amount of time and effort from the user. The user may not be able to remove the plug from the electronic device quickly.

BRIEF SUMMARY

According to an embodiment of the disclosed subject matter, a plug portion may be shaped to plug into a port of an electronic device. The plug portion may include electrical contacts to contact electrical contacts housed within the port of the electronic device. An external face may be attached to the plug portion. The external face may include electrical contact pads. The electrical contact pads may be electrically connected to the electrical contacts. A flange may include a ferromagnetic material attached to the external face, such that the flange is disposed outside of the electronic device when the plug portion is plugged into the port of the electronic device.

The plug portion may be in the shape of a male USB Type C connector. The plug portion has second order rotational symmetry. The electrical contacts of the plug portion are housed within the plug portion. The electrical contacts of the plug portion may be arranged such that each of the electrical contacts of the plug portion makes contact with an appropriate electrical contact housed within the port when the plug portion is inserted into the port in either of two orientations. The appropriate electrical contact housed within the port for each of the electrical contacts of the plug portion is based on the properties of the electricity carried by each of the electrical contacts of the plug portion. One of the electrical contacts of the plug portion may carry electricity used to power and charge the electronic device. One of the electrical contacts of the plug portion may carry data being sent or received by the electronic device.

The flange may be shaped to be connected to by a power cable. The power cable may include a connector including one or more spring pins that may establish an electrical connection between the power cable and the electrical contact pads. The connector may include a magnet. The force of a magnetic attraction between the magnet and the flange may be less than a friction force between the plug portion and the port and greater than a spring force of pushing the one or more spring pins out from the connector. The connector may include springs disposed with the one or more spring pins and adapted to push folded sides of the one or more springs into a casing of the connector, the casing carrying electricity. The flange and the external face may have second order rotational symmetry.

Electrically conductive casings may be disposed within a housing. A spring pin may be disposed within and in contact with the electrically conductive casings. Each of the spring pins may include a spring and a pin contact. The spring may push the pin out of the housing. A magnet may be disposed within the housing. An electrically conductive wire may be connected to a casing. The pin contact may include a folded side. A portion of the folded side may remain in contact with the casing when the pin contact moves within the casing. The housing may be shaped to fit around the flange of a dongle. The spring pins may establish an electrical contact with one or more contact pads of the dongle when the housing is attached to the dongle.

The housing and the spring pins may have second order symmetry such that the housing fits around the flange of the dongle in either of two orientations and each of the one or more spring pins makes contact with an appropriate one of the one or more contact pads in either orientation. The spring pins may carry electricity from the electrically conductive wire to the contact pads of the dongle to supply electricity and carry data to and from an electronic device in which the dongle is inserted. A force of magnetic attraction between the magnet and the flange may be less than a force of friction between the dongle and a port of an electronic device in which the dongle is inserted and greater than a force of the springs pushing the one or more pin contacts out from the housing.

A dongle may include a plug portion shaped to be inserted into the port of an electronic device. An external face may include contact pads. A flange may surround the external face. The plug portion may include contacts electrically connected to the contact pads. A power cable may include a connector. The connector may include electrically conductive casings disposed within a housing, a spring pin disposed within and in contact with the electrically conductive casings, each of the spring pins including a spring and a pin contact, the spring pushing the pin out of the housing, a magnet disposed within the housing, and electrically conductive wires connected to the casings. The connector may connect to the dongle such that the electrically conducted wire may electrically connected to a contact in the port of the electronic device.

The plug portion of the dongle may include a male USB Type C connector. The plug portion of the dongle may be adapted to be inserted into the port in either of two orientations. The electrically conductive wires may carry electricity used to power or charge the electronic device. The electricity may be carried to the electronic device through one of electrically conductive casings, one of the pin contacts, one of contact pads, one of the contacts of the plug portion, and one contact in the port of the electronic device. The electricity may have a current of 5 amperes or more. The electrically conductive wires may carry data being sent or received by the electronic device. The data may be carried to or from the electronic device through one of the electrically conductive casings, one of the pin contacts, one of the contact pads, one of the contacts of the plug portion, and the contact in the port of the electronic device.

A force of magnetic attraction between the magnet and the flange may be less than a force of friction between the dongle and the port of the electronic device in which the plug portion of the dongle is inserted and greater than a force of the springs pushing the one or more pin contacts out from the housing.

Systems and techniques disclosed herein may allow for a dongle for quick release. Additional features, advantages, and embodiments of the disclosed subject matter may be set forth or apparent from consideration of the following detailed description, drawings, and claims. Moreover, it is to be understood that both the foregoing summary and the following detailed description are examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
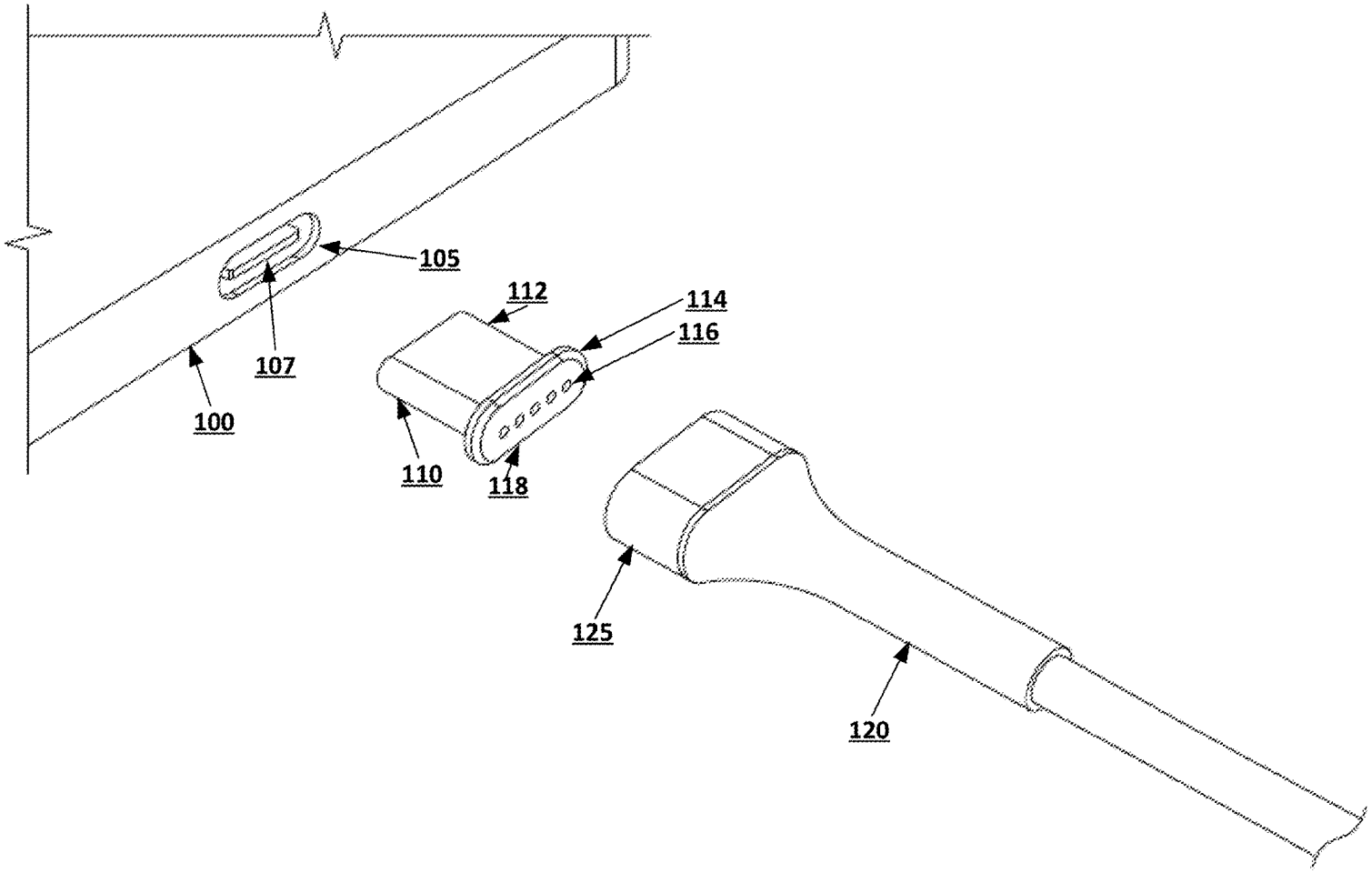
FIG. 1 shows an example perspective view of a dongle for quick release and power cable according to an implementation of the disclosed subject matter.

A dongle for quick release may allow for a user to attach and detach a power cable to an electronic device with less effort than a plug-in power cable. The dongle may be a plug shape device that may fit into any suitable external port of an electronic device, such as a smartphone, tablet, or LCD screen, laptop, or external hard drive. For example, the dongle may be shaped to fit into a USB Type C port. The dongle may connect to the power pins in the port of the electronic device, and may include external pads for connecting to a power cable. The dongle may not need to be oriented in one particular direction in order to be inserted into the port, as the port and the dongle may have pins on both sides, and the shape of the port may allow for insertion of the dongle in at least two different orientations. Part of the dongle, such as a flange around the external pads, may be made of a ferromagnetic material, such as ferromagnetic steel, to which a magnet may be drawn. A power cable may include a connector with spring pins, which may be arranged to line up with the external pads of the dongle. The connector of the power cable may also include a magnet. When the power cable's connector is brought near the magnetic material of the dongle, the magnet in the connector may be drawn to the material, causing the spring pins to come in contact with the external pads of the dongle. The magnet may hold the connector of the power cable against the dongle, and electricity may be supplied to the electronic device through the spring pins, the external pads, and the power pins inside the port of the electronic device. The force of the magnetic attraction between the magnet and the dongle may be balanced with the force of spring pins so that the spring pins don't disconnect the power cable. If the dongle is held in the port by friction, the force of the magnetic attraction may also be balanced with the friction forces so that the connector can be removed from the dongle without also removing the dongle from the port of the electronic device.

An electronic device, such as, for example, a smartphone, tablet, laptop, LCD television, or USB hard drive, may include a port used to supply electricity to the electronic device. The port may be used to power the device directly, and may also be used to charge batteries within the electronic device. The port may also be used for data transfer between the electronic device and another electronic device. For example, a smartphone may include a USB port which may allow the smartphone to be connected to another electronic device with a USB port, such as a laptop, or to a charger with a USB port. The port on the electronic device may be internal, and standard cables may need to be inserted into the port.

The port may be of any suitable type for the transfer of electricity and data, depending on the electronic device. For example, the port may be a USB Type C port. The port may be symmetrical. For example, a USB Type C port may have rotational symmetry, allowing an appropriate connector to be inserted into the USB Type C port in either of two different orientations without affecting the ability of the port to transfer data or electricity to the rest of the electronic device.

The dongle for quick release may be made of any suitable materials, and may be shaped to fit into any suitable port. For example, the dongle for quick release may include a plastic body in the shape of plug that may fit into a suitable port, such as, for example, a USB Type C port, with a steel flange that may rest against the body of the electronic device when the plug portion of the dongle is inserted into the port. The dongle may include any suitable internal connection pads, contacts, or pins, for establishing an electrical connection with pads, contacts, or pins in the port that may supply electricity and transfer data to and from the electronic device.

For example, the plug portion of the dongle may be in the shape of a male USB Type C connector, and may include the appropriate electrical contacts arranged in the appropriate manner for a male USB Type C connector. The dongle for quick release may share rotational symmetry with the port, allowing the dongle to be placed into the port in either of two different orientations, which may reduce the effort needed to place the dongle into the port as the dongle may only need to be oriented with respect to the length and width of the port.

The dongle may include a flange portion, such as a steel flange, which may be near, or may rest against, the body of the electronic device when the dongle has been inserted into the port. The flange may allow a user to grip the dongle, so that the user may insert the dongle into and remove the dongle from the port. The flange may be made of any suitable material, such as, for example, ferromagnetic steel, or other ferromagnetic metals that may be drawn to magnets. The flange may surround the external face of the dongle, which may be made of any suitable material, such as, for example, plastic, and may include contact pads. The contact pads may be, for example, gold contact pads. There may be any suitable number of contact pads on the external face of the dongle, and the contact pads may connect to the internal contacts in the plug portion of the dongle. For example, the dongle may include five gold contact pads which may be connected to ten internal contacts, with each contact pad connecting to one internal contact on the top of the inside of the plug portion and one internal contact on the bottom of the inside of the plug portion, in conformance with the pinout for USB Type C connectors.

The dongle may be held in the port in any suitable manner. For example, friction between the plug portion of the dongle and the port may hold the dongle in place, so that the dongle does not fall out of the electronic device while the electronic device is used. There may also be friction between the internal contacts of the plug portion of the dongle and the contacts within the port which may server to hold the dongle in the port until removed by a user.

A power cable may include a connector that may allow the power cable to be quickly attached and removed from the dongle for quick release. The power cable may be any suitable cable capable of delivering power, such as, for example a USB cable. The connector may include any suitable number of springs, which may be arranged so that each spring may make contact with one of the external contact pads on the face of the dongle when the connector is attached to the dongle. For example, the connector may include five spring pins, arranged to align with five contact pads on the face of the dongle. The power cable may include a second connector which may be used to attach the power cable to another electronic device. For example, the second connector may a USB connector that or may be a second connector, may be a second connector with spring pins that may attached to a second dongle in the port of a second electronic device. The power cable may carry data as well as electrical power.

The connector may include a magnet. The magnet may allow the connector to be attached to the dongle, for example, drawing the connector to a steel flange surrounding the face of the dongle, without relying on friction or physical mechanisms such as tabs. The force between the magnet and the flange of the dongle may be balanced against the friction force that holds the dongle in the port of the electronic device, so that the connector may be pulled away from the dongle easily, and may not pull the dongle out of the port of the electronic device. This may allow a user to quickly attach and release the connector from the dongle, as the magnetic force may draw the connector to the dongle when the connector is nearby, but may be easily overcome when user wishes to remove connector from the dongle. The connector may be symmetrical in the same manner as the dongle, and may, for example, attach to the dongle in either of two different orientations.

The spring pins in the connector may be made of any suitable material and in any suitable manner to allow the spring pins to make contact with the contact pads of the dongle without pushing the connector off of the dongle while also be able to handle a suitable amount of current. For example, the spring force of the springs used it the spring pin may be balanced against the force of the magnetic attraction between the connector and the dongle so that the spring spins do not push the connector away from the dongle with force greater than that holding the magnet to the flange. The spring pins may also be designed to carry, for example, up to 5 Amps of current without risking overheating, shorts, or failures, due to too much electricity being routed through the spring because of poor contact between the spring pin carrying power to the dongle and a sleeve surrounding the pin through which the spring pin receives current from the power cable. For example, a hoop spring oriented orthogonal to the direction of travel of the spring pin may be used to keep the spring pin in contact with the sleeve. This may ensure that power may be delivered to the spring pin through the sleeve, and may not end up traveling through main spring that governs the in and out motion of the spring pin.

The symmetry of the port, the dongle, and the connector may allow for the appropriate contacts to be made between internal connections pads, contacts, or pins on the dongle and contacts within the port, and the spring pins of the power cable connector, regardless of the orientation of the dongle, as long as the dongle is inserted into the port. For example, a VCC pin on the power cable connector may connect to the appropriate external contact pad on the dongle, which may connect to the appropriate internal contact of a male USB Type C connector of the dongle, which may in turn connect to the appropriate contact within a USB Type C port on an electronic device regardless of the orientation of the dongle and the power cable connector. This may allow for modulation of the power, including both voltage and current modulation, delivered to the electronic device through the port. No line switching may be needed to route power to the correct pin. The pins on the power cable connector that carry data may likewise be connected to the appropriate contact in the port through the external contact pad and internal contact of the dongle, regardless of the orientation of the dongle and the connector.

A target separation force may be selected, where the target separation force may be the amount of force needed to separate the connector from the dongle. The magnet and springs may be adapted to balance each other to result in the dongle being separable from the external face upon an application of approximately the target separation force. For example, if the target separation force is 1 NM and the ferromagnetic flange attracts a magnet in the connector with a force of 3 NM, then the springs may be adapted, based on characteristics such as material, winding density, and wire thickness, to exert a maximum force of 2 NM in opposition to the attractive force of the magnet. As another example, if the target separation force is 2 NM and the springs exert a maximum force of 3 NM, then the magnet and/or the configuration, for example, material and shape of the ferromagnetic flange can be adapted to result in an attractive force of 5 NM to a magnet in the connector. One or more springs may be disposed in the dongle, in the connector or in both. Likewise, one or more magnets and/or ferromagnetic materials may disposed in the dongle, in the connector, or in both.

FIG. 1 shows an example perspective view of a dongle for quick release and power cable according to an implementation of the disclosed subject matter. An electronic device 100 may be any suitable electronic device or computing device, such as, for example, a smartphone, tablet, laptop, LCD screen, or USB hard drive, or any other computing device as described, for example, in FIG. 7. The electronic device 100 may include a port 105, which may be any suitable port for receiving a cable that may deliver electricity to power or charge the electronic device 100, and may also allow for data transfer between the electronic device 100 and another electronic device. The port 105 may be, for example a USB Type C port. The port 105 may be symmetrical, for example, having second order rotational symmetry. Second order rotational symmetry may indicate that the port 105 can be rotated, for example, 180 degrees, and will appear the same as the port 105 had not been rotated at all. The port 105 may be rotationally symmetrical along both an axis down the length and an axis across the width of the port 105. The port 105 may include a tongue 107, on which the contacts for the port 105 may be placed.

A dongle 110 may be of any suitable shape to plug into the port 105 of the electronic device 100. The dongle 110 may include a plug portion 112, which may be shaped to fit into the port 105. For example, the port 105 may be a USB Type C port, and the plug portion 112 may be shaped like a male USB Type C connector. The plug portion 112 may be made of any suitable material, such as, for example, plastic. The plug portion 112 may also house any number of contacts, which may be aligned with contacts on the tongue 107 of the port 105.

The dongle 110 may include a flange 114, contact pads 116, and an external face 118. The flange 114 may surround the external face 118 at the front of the dongle 110, so that the flange 114 rests against or is near the body of the electronic device 100 when the dongle 110 is inserted into the port 105. The flange 114 may be made of any suitable ferromagnetic material, such as, for example, ferromagnetic steel. The external face 118 may be exposed when the dongle 110 when is inserted into the port 105, and may surround a number of contact pads 116. The external face may be made of any suitable non-conductive, non-magnetic material, such as, for example, plastic. The dongle 110 may include any suitable number of contact pads 116, in any suitable shape and made of any suitable material, such as, for example, gold. For example, the dongle 110 may include five contact pads 116. The five contact pads 116 may be electrically connect to the contacts housed within the plug portion 112 of the dongle 110. Inserting the plug portion 112 of the dongle 110 into the port 105 may result in an electrical connection between the contact pads 116 and the contacts on the tongue 106 of the port 105, so that, for example, electrical power delivered to the contacts pads 116 may be routed to the electronic device 100 to power, and to charge any batteries of, the electronic device 100.

The dongle 110 may include symmetry similar to that of the port 105. For example, the plug portion 112 of the dongle 110 may include rotational symmetry. This may allow the dongle 110 to be inserted into the port 105 in either of two different orientations. A user may only need to ensure that the dongle 110 is lined up length and width-wise with the port 105 in order for the plug portion 112 to fit properly into the port 105. The internal contacts in the plug portion 112 may also be symmetrical, so that the appropriate electrical connections are made with contacts on the tongue 107 regardless of the orientation at which the dongle 110 is inserted into the port 105. The dongle 110 may also include symmetry, for example, second order rotational symmetry, of the flange 114, external face 118, and contact pads 116.

A power cable 120 may include a connector 125. The power cable 120 may be any suitable cable for transferring power to the electronic device 100, and may also be used for transferring data between the electronic device 100 and another electronic device. The connector 125 may be any suitable shape to connect to the dongle 110. For example, the connector 125 may be of the same shape as the flange 114, and large enough to surround the flange 114. The connector 125 may include a number of spring pins, which may be aligned with the contact pads 116 of the dongle 110. When the dongle 110 is inserted in to the port 105, an electrical connection may be established between the spring pins and the contacts on the tongue 107 through the contact pads 116 and the internal contact housed in the plug portion 112. This may allow electrical power supplied to the power cable 120, for example, through a second connector of the power cable, to flow through the power cable 120 and the spring pins in the connector 125 and power or charge the electronic device 100 through the port 105. Data may also be delivered through the spring pins of the connector 125.

A magnet may be included within the connector 125. The magnet may draw the connector 125 to the flange 114, and may hold the connector 125 to the dongle 110. This may allow for quick connection and release of the connector 125 from the dongle 110, as a user may only need to overcome the magnetic force holding the connector 125 to the dongle 110, which may be easier than removing a plug that has been inserted into the port 105. The force of attraction between the magnet and the flange 114 that holds the connector 125 to the flange 114 may be less than the force, for example, from friction, which holds the dongle 110 into the port 105. This may prevent the connector 125 from pulling the dongle 110 out of the port 105 when the user attempts to remove the connector 125 from the dongle 110. The force of the spring pins in the connector 125 may be less than the force of the magnetic attraction between the magnet and the flange 114. This may prevent the springs in the spring pins from pushing the connector 125 off of the flange 114.

The connector 125 may be symmetrical in the same manner as the flange 114, external face 118, and contact pads 116 of the dongle 110. This may allow the connector 125 to be connected to the dongle 110 in, for example, either of two different orientations while still preserving the appropriate electrical connections between the spring pins and the contact pads 116.

Figure 2:
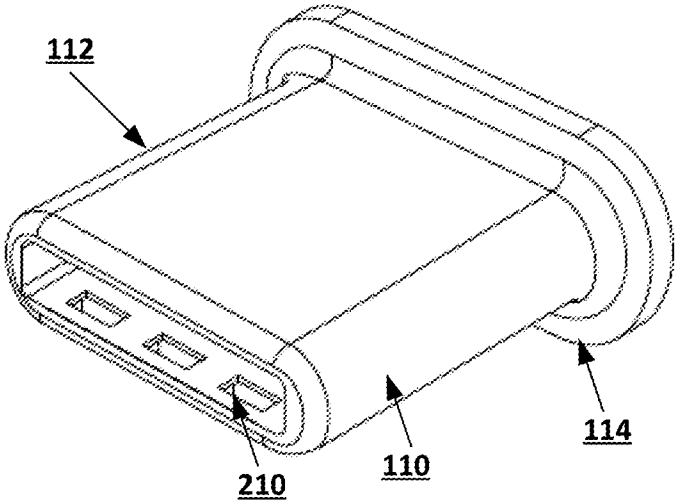
FIG. 2 shows an example perspective view of a dongle for quick release according to an implementation of the disclosed subject matter.

FIG. 2 shows an example perspective view of a dongle for quick release according to an implementation of the disclosed subject matter. The plug portion 112 of the dongle 110 may be shaped, for example, like a USB Type C male connector. The plug portion 112 may house internal contacts 210. There may be any number of internal contacts 210, arranged in any suitable manner. For example, the internal contacts 210 may be arranged to match the contacts within a USB Type C port. The internal contacts 210 may be arranged with symmetry, such that, for example, a top and bottom row of internal contacts 210 may be interchangeable, and the appropriate electrical connections with the contacts on the tongue 107 of the port 105 may preserved regardless of the orientation of the dongle 110 when it is inserted into the port 105.

Figure 3:
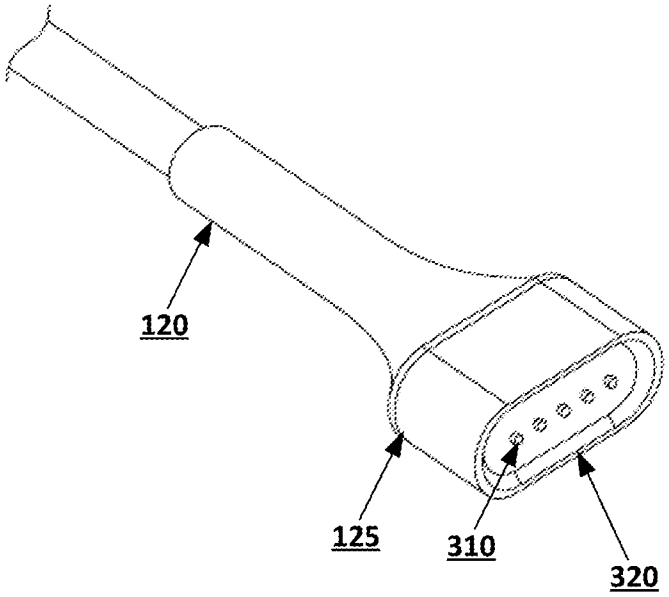
FIG. 3 shows an example perspective view of a power cable according to an implementation of the disclosed subject matter.

FIG. 3 shows an example perspective view of a power cable according to an implementation of the disclosed subject matter. The connector 125 of the power cable 120 may be shaped to fit on or around the flange 114 of the dongle 110. The connector 125 may include any number of spring pins 310, which may be arranged in any suitable manner to contact the contact pads 116 of the dongle 110. The spring pins 310 may be arranged to make contact with the appropriate contact pads 116, regardless of the orientation of the connector 125 relative to the dongle 110. For example, one of the spring pins 310 may be a VCC pin. The VCC pin may always connect to the appropriate contact pad 116, which may in turn connect to the appropriate internal contact in the plug portion 112 which may contact a VCC contact on the tongue 107 in order to deliver electrical power to the electronic device 100, while allowing for modulation of the voltage and current.

The connector 125 may include a magnet 320. The magnet 320 may be located in any suitable position on the connector 125, and may be of any suitable shape, size, and magnetic material. When the connector 125 is brought near the flange 114 of the dongle 110, there may be a magnetic attraction between the magnet 320 and the flange 114, resulting in the connector 125 being drawn into and held in place on the dongle 110, with the spring pins 310 in contact with the contact pads 116. The force of magnetic attraction between the magnet 320 and the flange 114 may be less than any friction forces that hold the dongle 110 in the port 105, and may exert more force than any spring forces exerted by the spring pins 310 on the contact pads 116.

Figure 4:
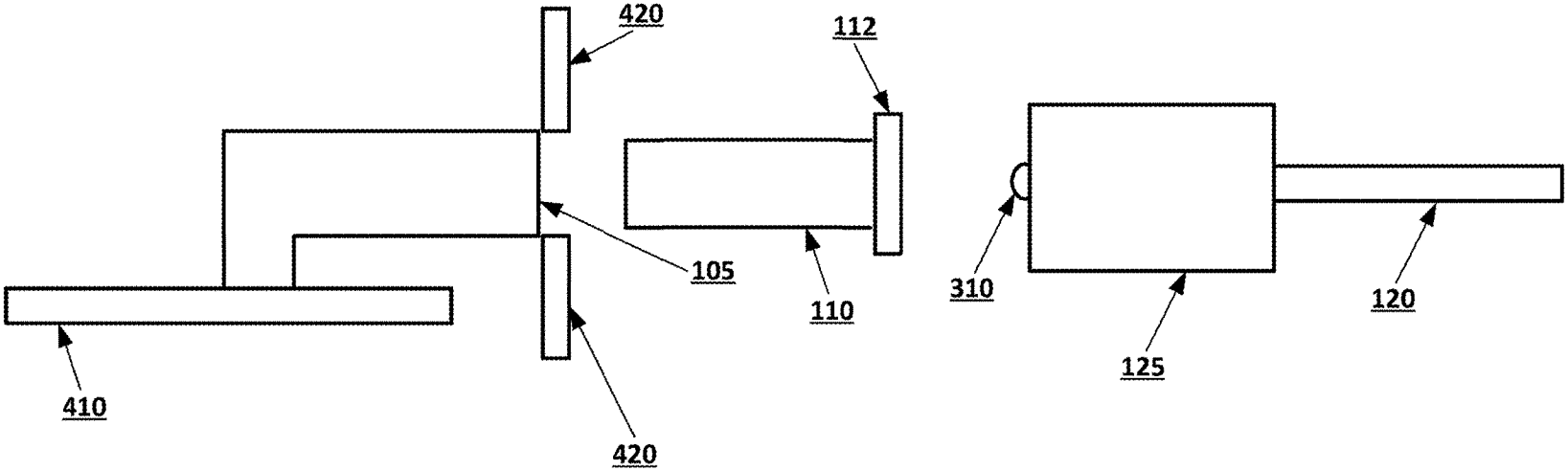
FIG. 4 shows an example side view of a dongle for quick release and power cable according to an implementation of the disclosed subject matter.

FIG. 4 shows an example side view of a dongle for quick release and power cable according to an implementation of the disclosed subject matter. The port 105 of the electronic device 100 may be attached to a PCB 410 in the electronic device 100. The PCB 410 may be, for example, a control board for the electronic device 100 that may connect the contacts on the tongue 107 with various components of the electronic device 100, such as, for example, a power supply circuit, a battery, a processor, or any other suitable component. The dongle 110 may be inserted into the port 105, which may be exposed through the casing 420 of the electronic device 100. The contacts housed within the plug portion 112 of the dongle 110 may contact the contacts on the tongue 107 to establish an electrical connection between the contacts pads 116 and the PCB 410 and components of the electronic device 100 attached to the PCB 410. The connector 125 may connect the power cable 120 to the dongle 110. The magnet 320 may attach the flange 114, which may be, for example, ferromagnetic steel. The spring pins 310 may contact the contact pads 116 of the dongle 110, establishing an electrical connection between the power cord 120 and the PCB 410. This may allow a power source connected to a second connector of the power cord 120 to supply electrical power to the PCB 410, which may power the electronic device 100 and charge any batteries in the electrical device 120. An electronic device, such as a laptop or desktop computer, may server as the power source, and may also establish a data connection with the electronic device 100 through the PCB 410.

Figure 5:
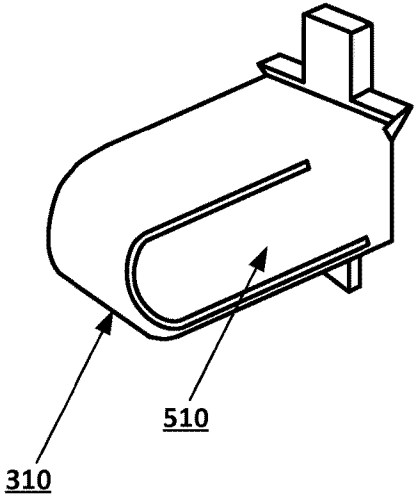
FIG. 5 shows an example perspective view of a spring pin for a power cable according to an implementation of the disclosed subject matter.

FIG. 5 shows an example perspective view of a spring pin for a power cable according to an implementation of the disclosed subject matter. The spring pins 310 used in the connector 125 of the power cord 120 may be shaped from a folded blank with a drawn tip. The blank may be any suitable material for use as the spring pins 310, such as a conductive metal. The spring pins 310 may be folded to accommodate a spring in between the folded sides 510. The folded sides 510 may also have folded up ends, which may be used to keep the spring pins 310 in electrical contact with a casing of the connector 125.

Figure 6A:
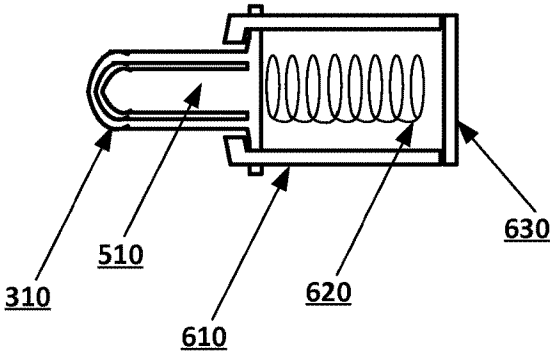
FIGS. 6A and 6B shows an example of side views of a spring pin for a power cable according to an implementation of the disclosed subject matter.
Figure 6B:
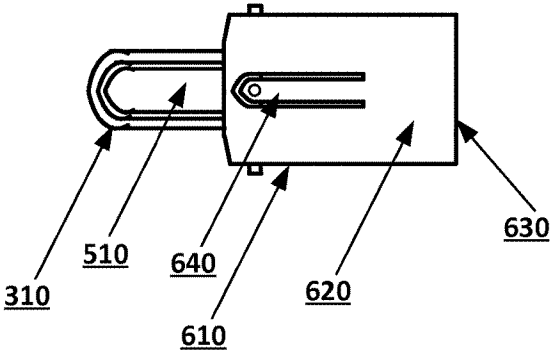

FIGS. 6A and 6B show an example of side views of a spring pin for a power cable according to an implementation of the disclosed subject matter. The spring pin 310 may be housed within an internal casing 610 which may be made from a conductive material. The internal casing 610 may have a backing 630. A spring 620, which may be, for example a helical spring, may be placed in between the spring 310 and the back 630. When the connector 125 is attached to the dongle 110, the spring 310 may be pushed into the contact pad 116, pushing back the spring 620. The spring force of the spring 620 may ensure the spring pin 310 maintains proper contact with the contact pad 116, but may not be strong enough to push the spring pin 310 far enough forward in the casing to detach the connector 125 from the dongle 100 by overcoming the force of magnetic attraction holding the magnet 320 to the flange 114. The folded ends of the spring pin 310 may ensure that spring pin 310 maintains electrical contact with the internal casing 610, preventing electricity from flowing through the spring 620. This may allow the connector 125 to handle current levels, such as, for example, 5 amps, needed for the powering and charging of the electronic device 100. A portion of the folded side 510 may also remain in contact with the internal casing 610 at contact 640 when the pin contact moves within the internal casing 610.

Figure 7:
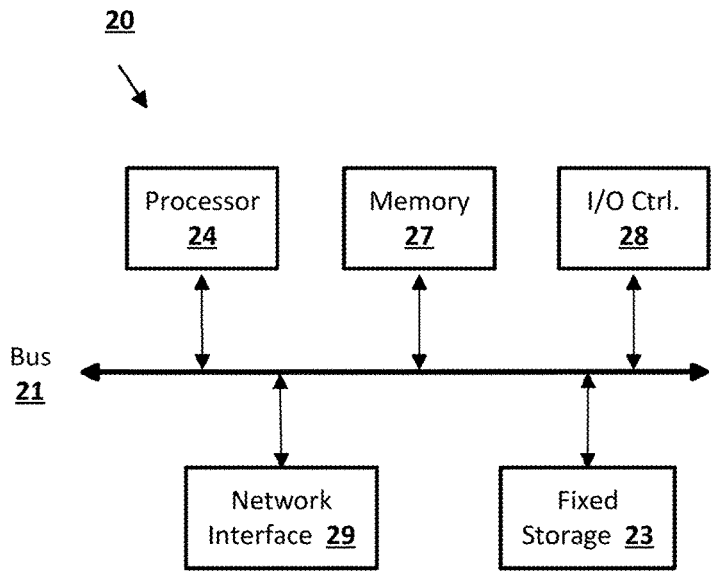
FIG. 7 shows a computer according to an embodiment of the disclosed subject matter.

Embodiments of the presently disclosed subject matter may be implemented in and used with a variety of component and network architectures. FIG. 7 is an example computer system 20 suitable for implementing embodiments of the presently disclosed subject matter. The computer 20 includes a bus 21 which interconnects major components of the computer 20, such as one or more processors 24, memory 27 such as RAM, ROM, flash RAM, or the like, an input/output controller 28, and fixed storage 23 such as a hard drive, flash storage, SAN device, or the like. It will be understood that other components may or may not be included, such as a user display such as a display screen via a display adapter, user input interfaces such as controllers and associated user input devices such as a keyboard, mouse, touchscreen, or the like, and other components known in the art to use in or in conjunction with general-purpose computing systems.

The bus 21 allows data communication between the central processor 24 and the memory 27. The RAM is generally the main memory into which the operating system and application programs are loaded. The ROM or flash memory can contain, among other code, the Basic Input-Output system (BIOS) which controls basic hardware operation such as the interaction with peripheral components. Applications resident with the computer 20 are generally stored on and accessed via a computer readable medium, such as the fixed storage 23 and/or the memory 27, an optical drive, external storage mechanism, or the like.

Each component shown may be integral with the computer 20 or may be separate and accessed through other interfaces. Other interfaces, such as a network interface 29, may provide a connection to remote systems and devices via a telephone link, wired or wireless local- or wide-area network connection, proprietary network connections, or the like. For example, the network interface 29 may allow the computer to communicate with other computers via one or more local, wide-area, or other networks, as shown in FIG. 8.

Many other devices or components (not shown) may be connected in a similar manner, such as document scanners, digital cameras, auxiliary, supplemental, or backup systems, or the like. Conversely, all of the components shown in FIG. 7 need not be present to practice the present disclosure. The components can be interconnected in different ways from that shown. The operation of a computer such as that shown in FIG. 7 is readily known in the art and is not discussed in detail in this application. Code to implement the present disclosure can be stored in computer-readable storage media such as one or more of the memory 27, fixed storage 23, remote storage locations, or any other storage mechanism known in the art.

Figure 8:
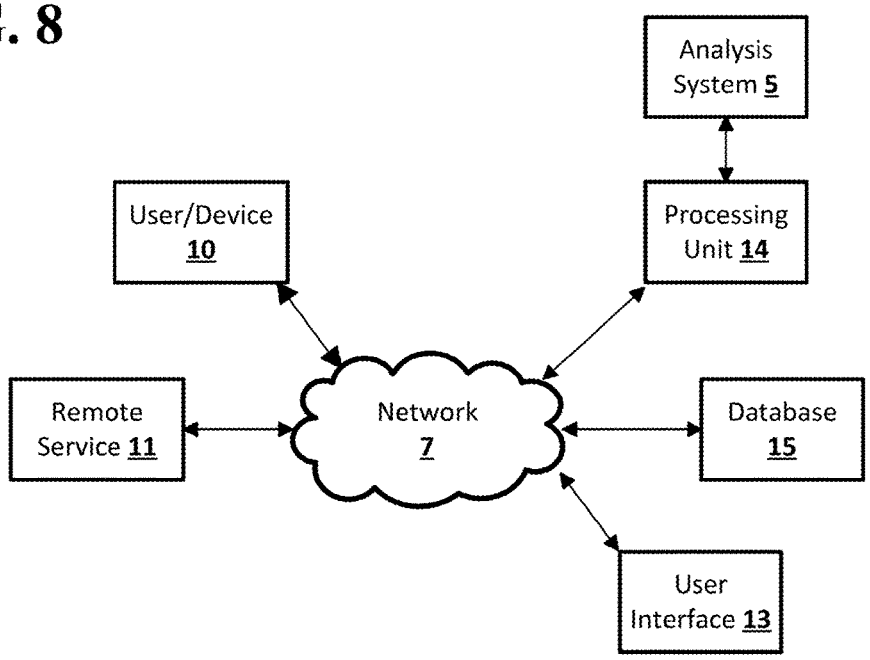
FIG. 8 shows a network configuration according to an embodiment of the disclosed subject matter.

FIG. 8 shows an example arrangement according to an embodiment of the disclosed subject matter. One or more clients 10, 11, such as local computers, smart phones, tablet computing devices, remote services, and the like may connect to other devices via one or more networks 7. The network may be a local network, wide-area network, the Internet, or any other suitable communication network or networks, and may be implemented on any suitable platform including wired and/or wireless networks. The clients 10, 11 may communicate with one or more computer systems, such as processing units 14, databases 15, and user interface systems 13. In some cases, clients 10, 11 may communicate with a user interface system 13, which may provide access to one or more other systems such as a database 15, a processing unit 14, or the like. For example, the user interface 13 may be a user-accessible web page that provides data from one or more other computer systems. The user interface 13 may provide different interfaces to different clients, such as where a human-readable web page is provided to web browser clients 10, and a computer-readable API or other interface is provided to remote service clients 11. The user interface 13, database 15, and processing units 14 may be part of an integral system, or may include multiple computer systems communicating via a private network, the Internet, or any other suitable network. Processing units 14 may be, for example, part of a distributed system such as a cloud-based computing system, search engine, content delivery system, or the like, which may also include or communicate with a database 15 and/or user interface 13. In some arrangements, an analysis system 5 may provide back-end processing, such as where stored or acquired data is pre-processed by the analysis system 5 before delivery to the processing unit 14, database 15, and/or user interface 13. For example, a machine learning system 5 may provide various prediction models, data analysis, or the like to one or more other systems 13, 14, 15.

In situations in which the implementations of the disclosed subject matter collect personal information about users, or may make use of personal information, the users may be provided with an opportunity to control whether programs or features collect user information (e.g., a user's performance score, a user's work product, a user's provided input, a user's geographic location, and any other similar data associated with a user), or to control whether and/or how to receive instructional course content from the instructional course provider that may be more relevant to the user. In addition, certain data may be treated in one or more ways before it is stored or used, so that personally identifiable information is removed. For example, a user's identity may be treated so that no personally identifiable information can be determined for the user, or a user's geographic location associated with an instructional course may be generalized where location information is obtained (such as to a city, ZIP code, or state level), so that a particular location of a user cannot be determined. Thus, the user may have control over how information is collected about the user and used by an instructional course provider.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. An apparatus comprising:

one or more electrically conductive casings disposed within a housing;

one or more spring pins, one of the one or more springs disposed within and in contact with one of the one or more electrically conductive casings, the one of the one or more spring pins comprising a spring and a pin contact, the spring pushing the pin contact out of the housing, the pin contact comprising at least one folded end extending out of the one of the one or more electrically conductive casings, wherein the folded end remains in contact with the one of the one or more electrically conductive casings when the one of the one or more spring pins moves;

a magnet disposed within the housing; and at least one electrically conductive wire connected to the one of the one or more electrically conductive casings wherein the one of the one or more spring pins receives electrical current from the conductive wire through the one of the one or more electrically conductive casings.

2. The apparatus of claim 1, wherein the pin contact further comprises a folded side, and wherein a portion of the folded side remains in contact with the casing when the pin contact moves within the casing.

3. The apparatus of claim 1, wherein the housing is adapted to fit around the flange of a dongle.

4. The apparatus of claim 3, wherein the one or more spring pins are further adapted to establish an electrical contact with one or more contact pads of the dongle when the housing is attached to the dongle.

5. The apparatus of claim 4, wherein the housing and the one or more spring pins have second order symmetry such that the housing fits around the flange of the dongle in either of two orientations and each of the one or more spring pins makes contact with an appropriate one of the one or more contact pads in either orientation.

6. The apparatus of claim 3, wherein the one or more spring pins are further adapted to carry electricity from the at least one electrically conductive wire to the one or more contact pads of the dongle to supply electricity and carry data to and from an electronic device in which the dongle is inserted.

7. The apparatus of claim 1, wherein a force of magnetic attraction between the magnet and the flange is less than a force of friction between the dongle and a port of an electronic device in which the dongle is inserted and greater than a force of the one or more springs pushing the one or more pin contacts out from the housing.

8. The apparatus of claim 2, wherein the one of the one or more electrically conductive casings further comprises a contact disposed in a side of the one of the one or more electrically conductive casings, the contact adapted to remain in contact with the folded side of the pin contact when the one of the one or more spring pins moves within the one of the one or more electrically conductive casings.

9. The apparatus of claim 2, further comprising a second spring disposed within the pin contact, the second spring adapted to push the folded side of the pin contact into contact with the one of the one or more electrically conductive casings.

10. The apparatus of claim 9 wherein the second spring comprises a hoop spring oriented orthogonal to a direction of travel of the one of the one or more springs pins within the one of the one more electrically conductive casings.

11. The apparatus of claim 2, wherein the pin contact comprises a blank of conductive metal, and wherein the folded sides and folded ends are shaped from folding of the blank of conductive metal.

* * * * *